United States Patent [19]

Beucher

[11] Patent Number: 4,459,799

[45] Date of Patent: Jul. 17, 1984

[54] QUAD GUIDE DEVICE FOR GUIDING QUADS TO A TELEPHONE CABLE STRANDING MACHINE

[75] Inventor: Michel Beucher, Calais, France

[73] Assignee: Les Cables de Lyon, Clichy Cedex, France

[21] Appl. No.: 483,081

[22] Filed: Apr. 7, 1983

[30] Foreign Application Priority Data

Apr. 9, 1982 [FR] France ..... 82 06244

[51] Int. Cl.[3] ..... H01B 13/02; H01B 13/04

[52] U.S. Cl. ..... 57/293; 57/13; 57/314; 57/352

[58] Field of Search ..... 57/3, 13–15, 57/314, 293, 294, 352

[56] References Cited

U.S. PATENT DOCUMENTS

| | | | |
|---|---|---|---|
| 2,028,158 | 1/1936 | Hodson | 57/314 X |
| 2,572,052 | 10/1951 | Pheazey | 57/293 X |
| 3,044,244 | 7/1962 | Merritt | 57/13 |
| 3,253,397 | 5/1966 | Gillis | 57/314 |
| 3,362,147 | 1/1968 | Curtis | 57/314 |
| 3,491,525 | 1/1970 | Sugi | 57/293 X |
| 3,526,570 | 9/1970 | Durkee et al. | 57/314 X |
| 3,572,024 | 3/1971 | Lyon | 57/293 X |
| 3,732,682 | 5/1973 | Crotty et al. | 57/314 X |
| 4,266,399 | 5/1981 | Ellis, Jr. | 57/293 |

FOREIGN PATENT DOCUMENTS

| | | |
|---|---|---|
| 1102345 | 5/1955 | France . |
| 1602865 | 2/1971 | France . |

*Primary Examiner*—John Petrakes

*Attorney, Agent, or Firm*—Sughrue, Mion, Zinn, Macpeak & Seas

[57] ABSTRACT

The quad guide device (18) receives quads (11) made on a first stranding assembly and guides them into a laying former (8) placed a head of a second stranding assembly. The guide device includes a distributor die (6) for distributing quads (11) at the output of the first stranding assembly and intermediate guide means (7) placed between the strand distributor die and the laying former. In said device, said guide means separate outer quads (11A) from inner quads (11B).

3 Claims, 4 Drawing Figures

QUAD GUIDE DEVICE FOR GUIDING QUADS TO A TELEPHONE CABLE STRANDING MACHINE

The present invention relates to a quad guide device for receiving quads made on a first stranding assembly and guiding them into a laying former placed ahead of a second stranding assembly, said guide device including a strand distributor die at the output of the first stranding assembly and intermediate guide means placed between the strand distributor die and the laying former.

"Stranding" in this context means twisting as opposed to untwisting. The quad guide device makes it possible to ensure that a cable is evenly stranded without leaving any non-stranded lengths, i.e. lengths whose strands lie parallel to the main axis of the cable and which would disturb the geometrical and electrical balance of said cable, in particular a telecommunications cable.

BACKGROUND OF THE INVENTION

In order to strand cables, in particular telephone cables, one present technique consists in stranding the cable on a machine known as an "SZ machine" which strands said cable alternately in one direction and then in the other, theoretically without ever leaving lengths where the wires are parallel to the main axis of the cable.

For example, such a machine can manufacture a cable having fourteen groups of four wires (i.e. fourteen quads). The wires are twisted together in groups of four by a first stranding assembly to form fourteen quads, and the quads are then twisted together in a second stranding assembly to manufacture the cable.

On the path between the first and second stranding assemblies, the fourteen quads are directed through a strand distributor die and are then grouped together by a laying former to form the actual cable before being covered by tape to prevent unquadding, being stranded again in accordance with the SZ principle of a second stranding assembly, and finally being wound onto a take-up spool before being transferred onto another machine.

As the individual quads pass between the strand distributor die and the laying former, they sometimes become tangled together, thereby leading to unquadding, i.e. leaving appreciable lengths untwisted. This causes geometrical and electrical unbalance, leading to crosstalk in use.

French patent FR-A-1, 602, 865 describes a cable-making installation which uses a collector of stranding head 15 (FIG. 3) placed between a strand distributor die and a laying former, but the collector 15 does not satisfactorily eliminate tanghing.

Preferred embodiments of the present invention reduce tangling.

SUMMARY OF THE INVENTION

The present invention provides a quad guide device for receiving quads made on a first stranding assembly and guiding them into a laying former placed ahead of a second stranding assembly, said guide device including a strand distributor die at the output of the first stranding assembly and intermediate guide means placed between the strand distributor die and the laying former, wherein said intermediate guide means separates outer quads from inner quads. Thus further protection against tangling is provided by a guide die or a guide cone either of which keeps the inner quads separate from the outer quads before they pass through the laying former.

Advantageously, said intermediate guide means comprises a strand guide die with orifices in its centre for the inner quads to pass through, and with curved peripheral notches to guide the outer quads.

Advantageously, said intermediate guide means comprise a hollow guide cone fixed in the strand distributor die and separating the inner quads from the outer quads, the inner quads being guided by the inside conical surface of the guide cone.

BRIEF DESCRIPTION OF THE DRAWINGS

A guide device in accordance with the invention and used for manufacturing a telephone cable having fourteen quads is described hereinafter by way of example and with reference to the figures of the accompanying drawings. In this particular case, one hundred and twelve spools connected in pairs are used to make automatic changes when necessary; thus, fifty six wires enter a first stranding assembly which produces fourteen quads. These fourteen quads enter a second stranding assembly which produces the actual telephone cable.

MORE DETAILED DESCRIPTION

Figure 1:
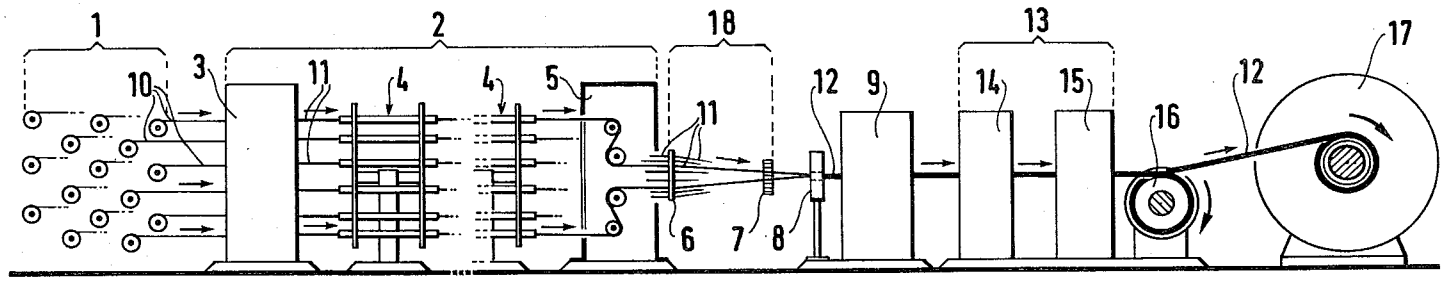
FIG. 1 is a schematic illustration of a cable stranding machine known as an "SZ machine" and which is used for manufacturing cables in accordance with the invention.

In FIG. 1, spools 1 deliver wires 10 to a first stranding assembly 2 which includes a first group 3 of stranding machines, a group of accumulators 4, and a second group 5 of stranding machines.

Quads 11 thus formed pass into a quad guide device 18 which has a strand distributor die 6 and a strand guide die 7, then the quads are drawn together in a laying former 8. A cable 12 thus formed is covered in a taping assembly 9, stranded in a second stranding assembly 13 having a first stranding head 14 and a second stranding head 15 hauled by a capstan 16 and wound on a drum 17. Said drum is then transferred on to another machine for subjecting the cable to further operations.

Figure 2:
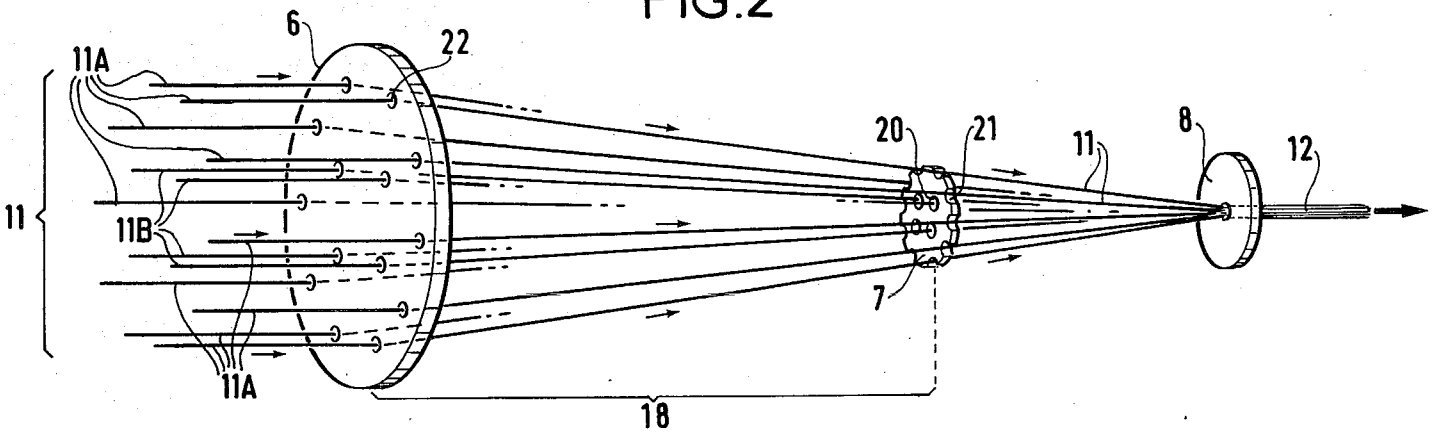
FIG. 2 is a perspective view to a larger scale of a guide device with its strand guide die and its laying former between the two stranding assemblies.

FIG. 2 shows a first embodiment of a quad guide device 18 in accordance with the invention and to a larger scale than FIG. 1. The device 18 has a strand distributor die 6 with orifices 22 for quads 11 to pass through, a guide die 7 with four central orifices 20 and ten curved notches 21 for ten outer quads 11. The central orifices 20 and the curved notches 21 may be lined with ceramics liners. The laying former 8 draws together all fourteen quads 11 of a cable 12, i.e. ten outer quads 11A and four inner quads 11B.

Figure 3:
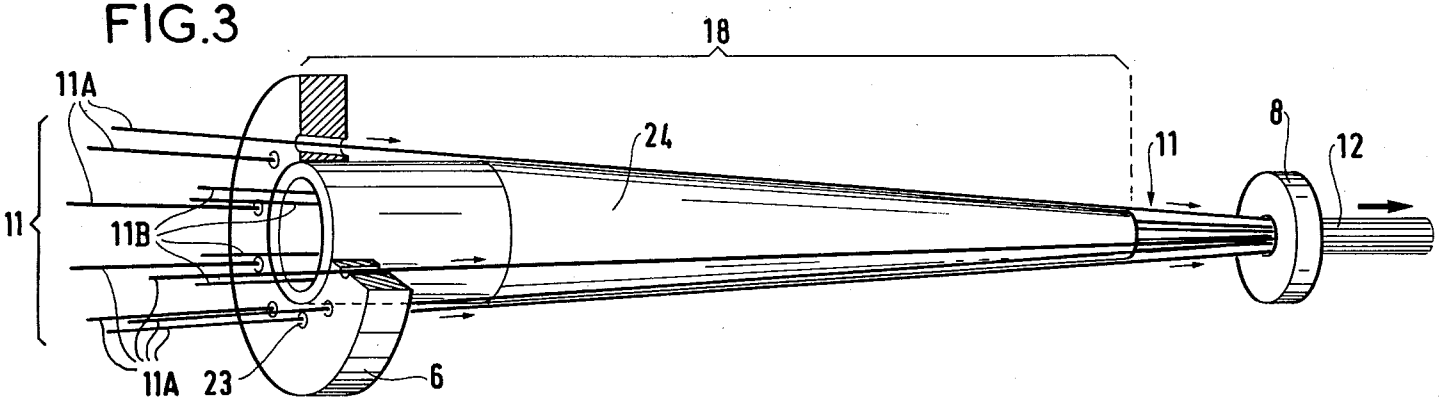
FIG. 3 is perspective view on the same scale as FIG. 2 of the guide device with its guide cone and its laying former between the two stranding assemblies.

FIG. 3 shows a second embodiment of the guide device 18. It comprises a strand distributor die 6 provided with orifices 23 through which the ten outer quads 11A pass, and a guide cone 24 fixed in the strand distributor die 6 in which four inner quads 11B pass.

The laying former 8 is also shown. It draws together the fourteen quads 11 which make up the cable 12.

Figure 4:
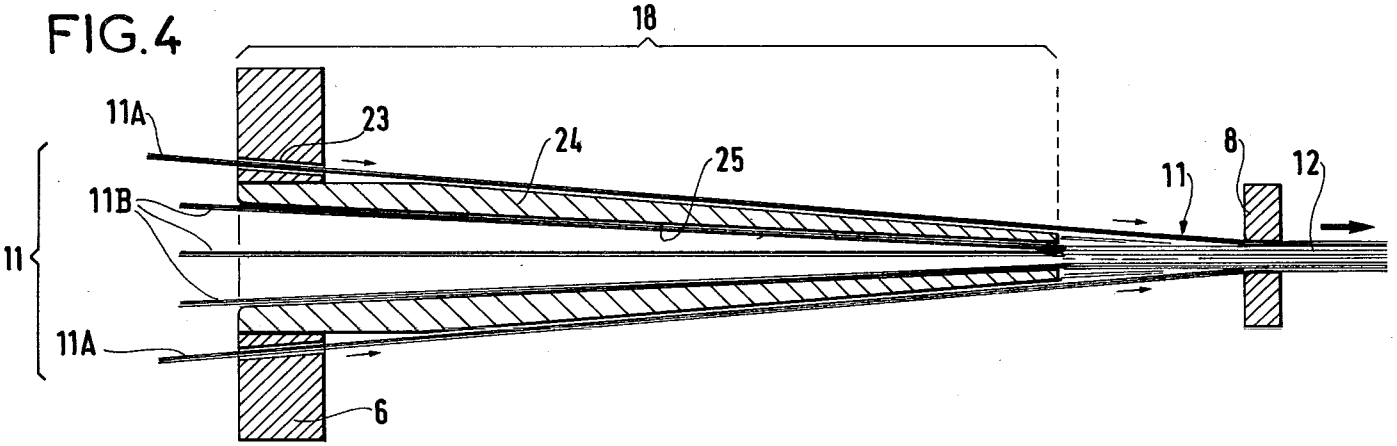
FIG. 4 is a longitudinal section through the device shown in FIG. 3.

In FIG. 4, which is a longitudinal section through FIG. 3 the ten outer quads 11A can be seen to be guided by the outside of the cone 24 while the four inner quads 11B are guided by the conical inside surface 25 of the cone 24.

Without going beyond the scope of the claims, a quad guide device in accordance with the invention can, of course, have some number of quad passing orifices other than 14 in order to be installed on a machine which manufactures cables with a number fo quads other than 14.

I claim:

1. A quad guide device for a telephone cable stranding machine having first and second longitudinally spaced stranding assemblies and wherein said first stranding assembly twists together fourteen groups of four wires to form fourteen quads and said second stranding assembly twists together said quads to form said cable, a laying former is positioned between said first and second stranding assemblies and just ahead of said second stranding assembly, and said guide device is positioned upstream of said laying former and downstream of said first stranding assembly and receiving said quads made on said first stranding assembly and guiding them into said laying former, said guide device comprising a strand distributor die at the output of the first stranding assembly and intermediate guide means positioned between the strand distributor die and the laying former for separating outer quads from inner quads.

2. A quad guide device according to claim 1, wherein said intermediate guide means comprises a strand guide die having a plurality of orifices within its interior through which the inner quads pass, and said strand guide die having a plurality of circumferentially spaced curved notches within its periphery through which pass the outer quads to guide the outer quads in the direction of the second stranding assembly.

3. A quad guide device according to claim 1, wherein said intermediate guide means comprises a hollow guide cone having a base fixed to the strand distributor die, said strand distributor die including a plurality of circumferentially spaced orifices within the interior of said die and opening to the exterior of the hollow guide cone, said outer quads passing through the orifices and contacting the outside conical surface of the guide cone, and wherein the center of said strand distributor die comprises a relatively large hole, and wherein the inner quads extend through said relatively large hole and contact the inside conical surface of the guide cone so as to be guided thereby and separated from the outer quads in contact with the outside conical surface of said guide cone.

* * * * *